US006910358B2

(12) United States Patent
Schroth

(10) Patent No.: US 6,910,358 B2
(45) Date of Patent: Jun. 28, 2005

(54) TWO TEMPERATURE TWO STAGE FORMING

(75) Inventor: James Gregory Schroth, Troy, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/647,401

(22) Filed: Aug. 25, 2003

(65) Prior Publication Data

US 2005/0044917 A1 Mar. 3, 2005

(51) Int. Cl.[7] ..... B21D 26/02; B21D 25/00
(52) U.S. Cl. ..... 72/57; 72/297; 72/342.7
(58) Field of Search ..... 72/296, 297, 57, 72/342.7, 342.8, 342.1

(56) References Cited

U.S. PATENT DOCUMENTS 2,344,743 A * 3/1944 Smith, Jr. ..... 72/57
2,952,294 A * 9/1960 Beverley et al. ..... 72/42
2,961,028 A * 11/1960 Bath ..... 72/297
3,584,487 A * 6/1971 Carlson ..... 72/38
4,754,635 A * 7/1988 van den Berg et al. ..... 72/350
5,206,036 A * 4/1993 Medwin ..... 425/327
6,253,588 B1 * 7/2001 Rashid et al. ..... 72/57
6,272,897 B1 * 8/2001 Ciranna ..... 72/296
6,672,121 B2 * 1/2004 Carsley et al. ..... 72/57

* cited by examiner

*Primary Examiner*—Daniel C. Crane
(74) *Attorney, Agent, or Firm*—Kathryn A. Marra

(57) ABSTRACT

A method is disclosed for two-stage stretch forming of a sheet metal blank workpiece between a preform tool with a concave cavity and an opposing finish-form punch tool. Both tools are independently heated to different forming temperatures with the preform tool being hotter. Gas pressure is first applied to one side of the workpiece in the first forming stage to balloon it into the cavity of the preform tool. Gas pressure is then applied to the other side of the preformed workpiece to stretch it against the finish-form surface. The hotter preform tool enables faster forming and gas venting in the first stage. The cooler finish-form tool enables the final shaping of the part and its undistorted removal from the punch surface.

15 Claims, 1 Drawing Sheet

TWO TEMPERATURE TWO STAGE FORMING

TECHNICAL FIELD

This invention pertains to hot stretch forming of a sheet metal blank between a preform tool (first stage) and then a final-form tool (second stage). More specifically, this invention pertains to such two stage stretch forming where the preform tool is maintained at a higher forming temperature than the final-form tool. This enables faster forming in the preform stage and distortion-free removal of the part from the final-form tool.

BACKGROUND OF THE INVENTION

Automotive body panels can be made by sheet metal stretch forming processes that use complementary, double action forming tools in a press and the pressure of a working gas to stretch form a preheated blank against the forming surfaces. In one embodiment, the process is applicable to stretch forming of a superplastically formable or quick plastically formable metal alloy blank into a sheet metal product of complex shape. The metal alloy may, for example, be a magnesium-containing, aluminum alloy having a fine-grained microstructure (grain size suitably less than ten micrometers) for high elongation plastic forming. Typically the aluminum alloy sheet has a thickness in the range of about 0.7 to 4 mm. The sheet metal blank is given a preform shape involving substantial elongation of the sheet. In a second action of the tools the preform is then shaped into the final product. Such a process is described in U.S. patent application Ser. No. 10/274,493, filed Oct. 17, 2002, entitled "Gas Pressure Preforming Double Action Superplastic or Quick Plastic Forming Tool and Method", and assigned to the assignee of this invention. That specification, including the drawing figures, is incorporated by reference into this application for its description of the two-stage forming process.

The method is particularly applicable to forming the sheet metal into a stretch formed product of complex three-dimensional curvature and regions of sharp corners and high elongation. For example, the invention is applicable to the forming of automotive vehicle body panels.

In accordance with two stage forming using gas pressure, the sheet metal is usually formed in a single press using complementary, but not mating, heated forming tools. The tools are in opposing (facing) relationship and movable from an open position, for insertion of a sheet metal blank, to their forming positions. Preferably, the blank is externally preheated to a desired forming temperature. After insertion of the preheated blank, the tools are moved to a first stage preforming position. The edges of the blank are gripped by a binder mechanism and gas pressure is applied to one side of the heated sheet to stretch it against a preform tool surface. The opposing, finish-shape tool is then moved closer to the preformed sheet in a second stage forming position. Gas pressure is applied to the opposite side of the sheet to force it back against the finish-form tool to complete the shaping of the sheet metal part. The press is then opened for removal of the formed part and insertion of a new blank.

The preform tool is shaped to accomplish a major portion of the stretching and elongation of the sheet in forming it toward the final part shape. The finish tool completes bends and recessed corners and defines the final detailed shape of the sheet metal produced in this press operation. In each forming stage, the pressure of a suitable working gas, such as air or nitrogen, is used to push and stretch the sheet against the respective tool surfaces. The pressure is applied to opposite sides of the sheet in the successive preform and finish-form steps. Thus, the necessary elongation lines or stretch directions in the sheet to form the part are predetermined. A substantial part of the elongation is accomplished in the preform step and is introduced nearly evenly over the preform shape. The final elongation is accomplished by forcing the preformed sheet away from the preform tool against the shaping surfaces of the finish shape tool.

This stretch forming process is efficient in its utilization of a single press with two forming tools. However, the working gas must be applied and vented from each side of the metal workpiece and the forming must be done at a strain rate that does not introduce defects in the visible surface of the formed part. The overall process has remained slow for high volume production operations. Accordingly, it is an object of this invention to increase the forming speed of the two stage stretch forming process and minimize localization of the strain in the formed part.

SUMMARY OF THE INVENTION

The practice of this invention focuses on control of the respective temperatures of the preform tool and the finish-form tool in the two stage stretch forming of suitable sheet metal blanks. Both tools are preferably insulated from the supporting press structure and independently, internally heated to provide different uniform temperatures across their respective forming surfaces. The blanks are typically preheated for the two stage forming process.

Briefly stated, the preforming tool is maintained at a relatively high temperature to facilitate rapid plastic elongation of the sheet material as it is stretched under suitable working gas pressure and ballooned against the surface of the preform tool. The preform tool preferably has a concave surface to receive the ballooning blank. The relatively high temperature of the preform tool surface permits the preheated blank to be initially shaped at a relatively high strain rate for the sheet metal alloy. A purpose of the higher preform temperature is to use a lower working gas pressure, consistent with a high strain rate, which permits more rapid venting of the preform gas. Thus, the preform step introduces substantial elongation in the blank by establishing a gross shape approximating the final shape of the part. Such preforming permits the final forming of the detailed bends, curvatures and other shape features in the final part without tearing or marring of the formed part.

The temperature of the finish-form tool surface is lower than the surface of the preform tool. This means that the preform part experiences some cooling as it is pushed from the preform tool to the finish form tool. The finish-form step is carried out at a somewhat lower temperature at which the sheet metal retains suitable ductility for final forming but also achieves more rigidity for distortion-free removal of the part from the finish-form tool.

The practice of this invention is useful in the two stage stretch forming of any sheet metal having suitable ductility at an elevated temperature for such plastic deformation. Various aluminum, magnesium titanium and ferrous alloys can be processed into sheets having a ductile metallurgical microstructure. Usually the sheets are formed by hot rolling a cast billet to a strip and then cold rolling the strip to a sheet of desired thickness and surface finish. Depending upon the material, the cold worked sheet may be heat treated to obtain the necessary ductility.

In one illustrative embodiment, this invention is used in the stretch forming of magnesium containing aluminum alloys (such as AA5083) that have been cold rolled and recrystallized to a very fine grain structure. These alloys display tensile elongations in excess of 300% at forming temperatures in the range of 450° C. to about 550° C. and have been formed into automotive body panels such as deck lid outer panels. In such an embodiment, this invention is practiced, for example, by preheating the blank to about 500° C. and maintaining the preform tool at the same temperature and the finish-form punch at about 440° C.

Other objects and advantages of the invention will be understood from a detailed description of a preferred embodiment which follows.

DESCRIPTION OF A PREFERRED EMBODIMENT

This invention has application in the two-stage stretch forming of a heated sheet metal work piece in a process where pressurized air or nitrogen is applied first to one side of the workpiece and then the other side to first stretch it against a heated preform tool and then against a heated finish form tool. As described in the above referenced U.S. patent application, articles of complex shape such as automobile body panels can be made by such a practice using suitable high elongation alloys.

For purposes of illustration the practice of this invention will be described in the quick plastic forming of fine grained, superplastically formable AA5083 sheet material about 1.5 mm in thickness. Suitable press and tooling apparatus will be described for the practice of a preferred embodiment of the method of this invention.

Figure 1:
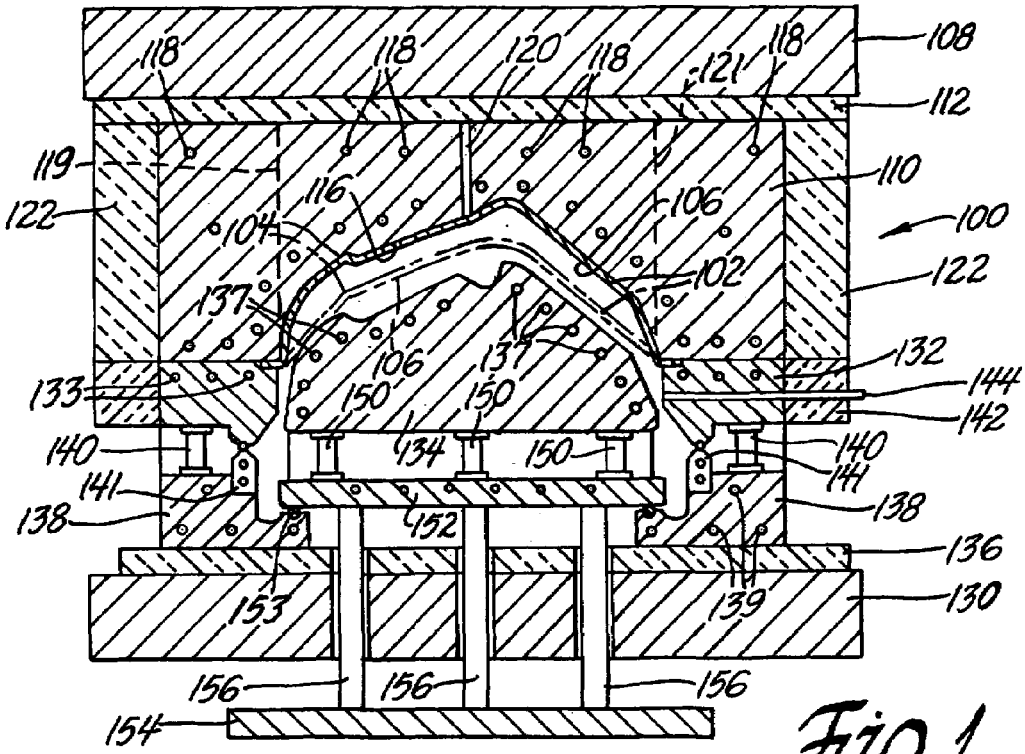
FIG. 1 is an elevation view in cross section of separately heated and temperature controlled upper preform tool and lower finish form tool with a sheet metal workpiece shown stretched against the preform tool.
Figure 2:
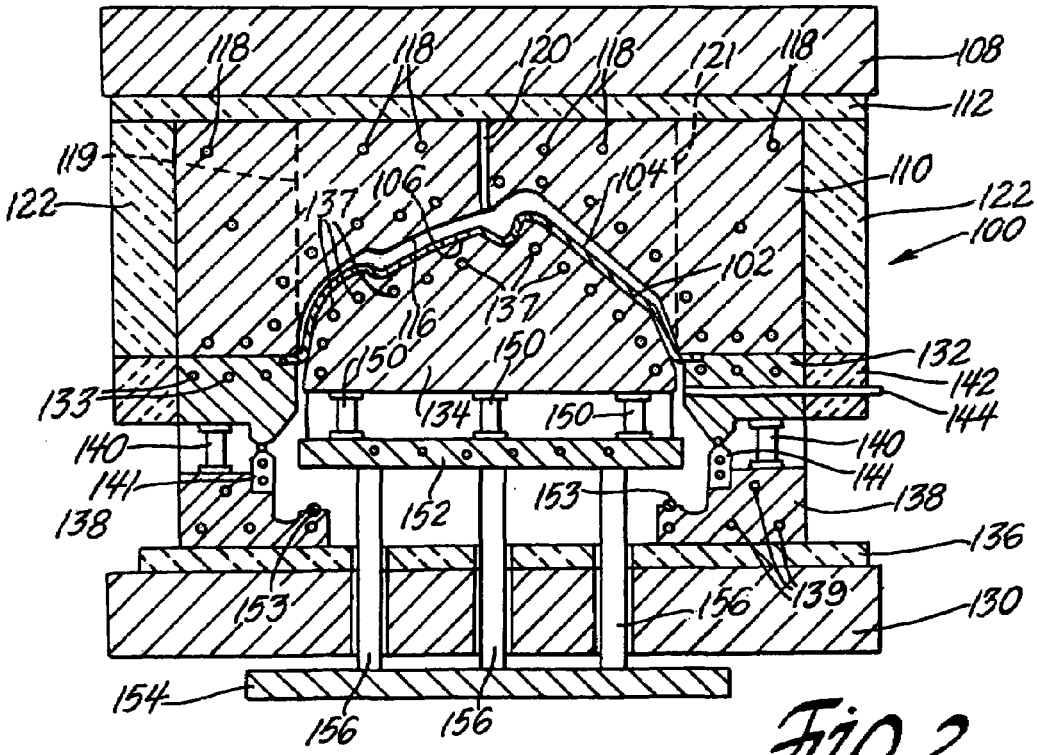
FIG. 2 is an elevation view in cross section like FIG. 1 with the sheet metal workpiece shown stretched against the finish form tool.

FIGS. 1 and 2 are schematic illustrations in cross section of an elevation view of press platens and two complementary, but not mating, forming tools useful in a preferred embodiment of the invention. They illustrate the forming an automotive body closure panel such as a deck lid outer panel preform configuration as illustrated in FIG. 1 of the above referenced patent application and then a deck lid panel final configuration as seen in FIG. 2 of that U.S. application.

Referring first to FIG. 1 of this specification, the press and tooling assembly is indicated generally and schematically at 100 and is shown in an operative position for the preforming of a sheet metal blank 102. Blank 102 is shown in cross section and on edge in full line depiction in its preform position as will be described shortly. Sheet metal blank 102 (with a dashed lead line) is also shown in a preliminary position before preforming. As best seen on the blank 102 preliminary position, the blank has an upper surface 104 and a lower surface 106.

The press and tooling combination 100, comprises an upper press platen 108 (the full press structure and hydraulic actuating mechanisms are conventional and not shown to reduce the complexity of the illustration). Securely attached to upper press platen 108 is a preform tool 110 which is generally concave in configuration. An insulation layer 112 thermally isolates preform tool 110 from upper platen 108. Similarly, the sides of preform tool 110 are wrapped in insulation layers 122. Preform tool 110 includes a preform surface portion 116 for use in shaping the workpiece preform from blank 102.

Preform tool 110 is internally heated and it is thermally insulated from the upper press structure. Thus, preform tool 110 comprises a plurality of heating elements 118 for maintaining the tool and surface 116 at a temperature suitable for forming of the AA5083 sheet material. An illustrative preform tool temperature for this magnesium containing aluminum alloy is, for example, 500° C. In addition to the insulation layer 112 between press platen 108 and preform tool 110, the four sides of preform tool 110 are enclosed in insulation blocks 122 (two blocks shown in the sectional views of FIGS. 1 and 2).

Heating elements 118 are suitably commercially available electrical resistance heaters that are connected to suitable available electric power supply and electrical control units, not shown. While the specific heating elements may be of like construction and function it is often preferred to connect them for electrical control purposes in several different control zones (zone boundaries 119, 121) as indicated on tool 110 in FIG. 1. It is preferred to closely control the temperature of preform tool 110 and preform surface 116 at a specified uniform temperature. Depending on the size and shape of the tool 110, the heater current draw requirements in different heater element 118 zones can vary due to differences in heat losses. As suggested by the spacing of heating zone boundary lines 119, 121 in FIGS. 1 and 2 for tool 110, the central heating zone between boundaries 119 and 121 may be larger and its heater elements maintained at an appropriate temperature for the heating of preform surface 116 to a specified uniform temperature. The heater zones outside the boundaries 119 and 121, outside the preform surface 116, may require different current draws or duty cycles to contribute to the uniform temperature of preform surface 116.

Preform tool 110 also includes a gas port 120 for admitting a working gas under pressure for a forming operation to be described below. Air or nitrogen is typically used as the working gas. The working gas is vented through gas port 120, or other venting port, when the forming operation is completed.

The press lower platen 130 carries a binder ring 132 and a punch tool 134. Lying on press lower platen 130 is a layer of insulation material 136. Insulation layer 136 carries a water cooled support structure 138 for binder ring 132. The water passages are indicated at 139. Support structure 138 carries cylindrical columns 140 for carrying binder ring 132. Enclosing binder ring 132 is an insulation ring 142. Binder ring 132 contains heating elements 133. Punch 134 likewise contains heating elements 137 for maintaining the punch tool at the specified forming temperature of the sheet metal blank 102. In the finish-forming of the AA5083 preform, punch 134 is suitably maintained at a uniform temperature of about 440° C.

A preheated sheet metal blank is initially deposited on convex punch 134 when the press/tool assembly 100 is in its open position (not shown in the drawing figures). The hot flexible sheet drapes itself over punch 134 and binder ring structure 132. When the press is closed for preforming, or first stage forming, the edges of the draped sheet 102 are gripped between the edges of the preform tool 110 and the binder ring 132. The position of the blank at that time is as indicated at its outline position 102 in FIG. 1. The edges of the blank remain gripped between the preform tool 110 and the binder ring 132 throughout the two stage forming process and until the press is opened for removal of the formed part.

Gas port 144 extending through insulation 142 and binder ring 132 permits the introduction of working gas against the back side 106 of sheet blank 102 during the preform step as will be described below. Sealing ring 141 between binder ring 132 and support 138 helps seal the working gas within the press/tool assembly 100 during the preform step as seen in FIG. 1.

With the preheated, flat sheet metal blank 102 loaded in the open press/tool assembly 100, the forming process proceeds as follows.

Referring to FIG. 1, the upper press platen 108/cavity tool 110 assembly is now closed against binder ring 132. Relative movement of upper platen 108 and lower platen 130 closes the press/tool assembly 100 to the FIG. 1 position. Cavity tool 110 is now positioned close to the punch tool 134. In this closed position of the press/tool assembly 100, cavity tool 110 and binder ring 132 tightly secure the periphery of the sheet metal blank 102. The secured blank 102 thus closes the press space around punch 134 so that working gas pressure can be maintained against lower side 106 of blank 102. There is an additional sealing feature in the press/tool assembly 100 which is described below.

Air under suitable pressure is introduced through gas port 144 so that air pressure is applied to the lower side 106 of blank 102. This pressure forces the preheated blank 102 against the cavity surface 116 and stretching or ballooning it into desired compliance with the cavity tool, preform shaping surface as seen in cross-section in FIG. 1. The preheat softened blank and the relatively high temperature of the internally heated tool permit the blank to be stretched at a gas pressure and strain rate suitable for practical and efficient forming cycles.

The air pressure is suitably applied in appropriate increasing increments as described, for example, in the Rashid et al patent, U.S. Pat. No. 6,253,588, Quick Plastic Forming of Aluminum Alloy Sheet Metal. Within a short period (e.g., 20 to 100 seconds) the heated blank 102 has assumed the shape of the preform tool 110 as illustrated in FIG. 1. When the preform stretching and shaping of the blank 102 has been completed the working gas is released through gas port 144 or other venting port. In general, much of the metal stretching required to make the final part shape is introduced in the preform step. Final bending and corner details and the like are accomplished in the next forming stage.

As shown in FIGS. 1 and 2, punch tool 134 is carried by the lower press platen 130 at support ring 138 but is movable separately from platen 130. Punch tool 134 is carried on cylindrical supports 150 which are carried on water cooled plate 152. In FIG. 1, plate 152 rests on support ring 138. O-ring 153 mounted in a groove in water cooled support ring 138 provides a gas seal for the above described preform operation when plate 152 rests on it.

Plate 152 is connected to punch platen 154 by rods 156 which extend through insulation plate 136 and press platen 130. Rods 156 are based on platen 154. Punch platen 154 is actuated by means, not shown, to move punch 134 independently of the motion of press lower platen 130. This independent motion of punch 134 provides the "second stage" operation of the subject tooling and forming process.

After sheet metal blank 102 has been subjected to the preform step as illustrated in FIG. 1, the internally heated punch tool 134 is raised for the final sheet metal forming step. In FIG. 2 it is seen that punch platen 154 has been raised and the surface of the punch 134 is now in closer proximity with the cavity tool 110. Air is vented from between the punch 134 surface and the sheet metal 102 (now in its preform shape) through port 144, or other venting port, in the binder ring 132. Air pressure is now introduced through the cavity tool 110 through gas port 120. The sheet metal 102 is forced away from the surface of the cavity tool 110 and it is stretched into contact with the surface of punch tool 134 as shown in FIG. 2. Back surface 106 of sheet metal 102 is in full contact with the surface of punch 134.

The temperature of this final-form tool, punch 134 is significantly lower than the temperature of preform tool 110. This lower temperature is possible because each tool is separately and internally heated. And, as described, each tool is insulated from the supporting press structure and, except for their opposing surfaces, they are insulated from each other. The lower temperature of this final-form tool is suitable for lower strain rate finish shaping of the workpiece and to reduce the temperature of the sheet to facilitate prompt removal of the heat softened part from the tool when the press is opened.

Again, the air pressure is gradually increased in increments for final-forming and within a short period of, e.g., 80 to 200 seconds the preformed sheet metal has been stretched against the surface of the punch tool 134 so that it assumes the final product configuration, FIG. 2, obtained in this tool/press assembly 100. The air pressure is then released through gas port 120 or other suitable venting port.

The cavity tool 110 and punch tool 134 are now separated (not shown in the drawing figures) by activation of their respective platens 108, 130 and 154 for removal of the finish formed part from the press. The part is removed and suitably cooled. Any trimming operations and the like are accomplished to finish the making of the part. The press is now in its open position and the tooling is ready for the insertion of a new blank 102 so that the process starts again to form the next part.

The above described two-stage forming of a heat softened metal sheet requires, among other process and equipment parameters, careful control of the temperature of the workpiece if it is to be formed in a practical time without tearing or other damage to the formed part. The practice of this invention results in new process efficiencies by focusing on the control of the temperatures of the shaping tools. The method utilizes separately and internally heated preform and finish-form tools to shorten the duration of the forming steps while making defect-free parts. The tools are maintained at different temperatures with the preforming tool at the higher temperature.

The hotter preform tool increases the formability of the workpiece. Such increased formability enables the sheet to be stretched to its preform shape at a higher strain rate and lower working gas pressure. Stretching at a higher strain means that the sheet can be stretched faster. For example, by increasing the temperature of AA5083 sheet material by 50° C., from 425° to 475° C., the useful strain rate can be increased from $0.004s^{-1}$ to $0.01\ s^{-1}$ at a gas pressure of 83 psi. Use of lower gas pressure enables the gas to be vented from the preform stage faster.

There are also advantages from use of a cooler finish-form tool. The final forming is preferably done at a lower strain rate to assure the detailed shaping of a defect-free part. And the cooler part is easier to remove from the finish-from tool without distortion.

The practice of the invention has been described by an illustrative example. But the scope of the invention is broader and not limited by the example.

What is claimed is:

1. A method of two-stage stretch forming of a preheated sheet metal blank into a first stage preform shape and then a second stage finish shape part, said blank having a first side and a second side, said method comprising stretching said blank to said preform shape by pushing said second side against a preform surface on a preform tool, said preform tool being internally heated to maintain said preform surface at a preform temperature for stretching said blank to said preform shape; and immediately thereafter stretching the preform shape blank to a finish shape part by pushing said first side against a finish form surface on a finish form tool, said finish form tool being internally heated to maintain said finish form surface at a finish form temperature for said preform shape blank, said finish form temperature being lower than said preform temperature.

2. The method of stretch forming a sheet metal blank as recited in claim 1 comprising maintaining said preform surface at a preform temperature for stretching said blank to said preform shape at a higher strain rate than the strain rate for stretching said preform shape blank to said finish shape part.

3. The method of stretch forming a sheet metal blank as recited in claim 1 in which said finish form surface is maintained at a finish form temperature for removal of said finish shape part from said finish form surface.

4. The method as recited in claim 1 in which said stretching steps are accomplished by applying a pressurized working gas against said first side of said blank to obtain said preform shape and then applying a pressurized working gas against the second side of said blank to obtain said finish shape part.

5. The method as recited in claim 1 in which said sheet metal blank comprises a stretch formable alloy of a metal selected from the group consisting of aluminum, iron, magnesium and titanium.

6. A method of two-stage stretch forming of a sheet metal blank into a first stage preform shape and then into a second stage finish shape part, said blank having a first side and a second side, said method comprising heating said blank to a preforming temperature for stretch elongation of said sheet under the pressure of a working gas;

placing said heated blank between opposing stretch forming tools comprising a preform tool with a concave preform surface and a finish form tool with a convex finish form surface;

applying a pressurized working gas against the first side of said blank to stretch the second side of the blank against said preform surface to obtain a preform shape blank, said preform tool being internally heated to maintain said preform surface at a preform temperature for stretch elongation of said blank;

releasing said working gas from the first side of said blank;

applying a pressurized working gas against the second side of said blank to push the second side from said preform surface and to stretch the preform shape blank against said finish form surface, said finish form tool being internally heated to maintain said finish form surface at a finish form temperature for said preform shape blank, said finish form temperature being lower than said preform temperature;

releasing said working gas from the second side of said blank; and removing the finish shape part from said finish form surface.

7. The method of stretch forming a sheet metal blank as recited in claim 6 comprising maintaining said preform surface at a preform temperature for stretching said blank to said preform shape at a higher strain rate than the strain rate for stretching said preform shape blank to said finish shape part.

8. The method of stretch forming a sheet metal blank as recited in claim 6 in which said finish form surface is maintained at a finish form temperature for removal of said finish shape part from said finish form surface.

9. The method of stretch forming a sheet metal blank as recited in claim 6 comprising maintaining said preform surface at a preform temperature for stretching said blank to said preform shape at a lower pressure of working than the working gas pressure for stretching said preform shape blank to said finish shape part.

10. The method of stretch forming a sheet metal blank as recited in claim 6 comprising maintaining said preform surface at a preform temperature for (a) stretching said blank to said preform shape at a higher strain rate than the strain rate for stretching said preform shape blank to said finish shape part or (b) stretching said blank to said preform shape at a lower pressure of working than the working gas pressure for stretching said preform shape blank to said finish shape part, and said finish form surface is maintained at a finish form temperature for removal of said finish shape part from said finish form surface.

11. The method as recited in claim 6 in which said sheet metal blank comprises a stretch formable alloy of a metal selected from the group consisting of aluminum, iron, magnesium and titanium.

12. The method as recited in claim 6 in which said sheet metal blank is formed of a fine grain, magnesium containing aluminum alloy.

13. The method as recited in claim 10 in which said preform temperature for said preform surface is in the range of about 475° C. to about 540° C. and said finish form temperature for said finish form surface is in the range of about 400° C. to about 460° C.

14. The method as recited in claim 11 in which said blank is preheated to a temperature in the range of about 475° C. to about 540° C.

15. A method of two-stage stretch forming of a sheet metal blank of a fine grain, magnesium containing aluminum alloy into a first stage preform shape and then into a second stage finish shape part, said blank having a first side and a second side, said method comprising heating said blank to a preforming temperature in the range of about 475° C. to about 540° C.;

placing said heated blank between opposing stretch forming tools comprising a preform tool with a concave preform surface and a finish form tool with a convex finish form surface;

applying a pressurized working gas against the first side of said blank to stretch the second side of the blank against said preform surface to obtain a preform shape blank, said preform tool being internally heated to maintain said preform surface at a preform temperature in the range of about 475° C. to about 540° C.;

releasing said working gas from the first side of said blank;

applying a pressurized working gas against the second side of said blank to push the second side from said preform surface and to stretch the preform shape blank against said finish form surface, said finish form tool being internally heated to maintain said finish form surface at a finish form temperature in the range of about 400° C. to about 460° C.;

releasing said working gas from the second side of said blank; and removing the finish shape part from said finish form surface.

* * * * *